US009189933B1

(12) United States Patent
Stevens et al.

(10) Patent No.: US 9,189,933 B1
(45) Date of Patent: Nov. 17, 2015

(54) PORTAL-SECURITY DETECTION MECHANISM

(71) Applicant: Leeo, Inc., Palo Alto, CA (US)

(72) Inventors: Andrew G. Stevens, Palo Alto, CA (US); Bjorn H. Hovland, Woodside, CA (US)

(73) Assignee: Leeo, Inc., Palo Alto, CA (US)

( * ) Notice: Subject to any disclaimer, the term of this patent is extended or adjusted under 35 U.S.C. 154(b) by 0 days.

(21) Appl. No.: 14/470,753

(22) Filed: Aug. 27, 2014

(51) Int. Cl.
*G08B 13/08* (2006.01)

(52) U.S. Cl.
CPC ..... *G08B 13/08* (2013.01)

(58) Field of Classification Search
CPC ..... G08B 13/08; G08B 23/00; G05B 15/02; G06Q 10/0635; G08C 19/00; H04L 2209/72; H04L 63/10; H04L 9/0861; H04Q 2209/10; H04Q 2209/40; H04Q 9/00
USPC ..... 340/545.1, 541, 539.26, 547, 207.22
See application file for complete search history.

(56) References Cited

U.S. PATENT DOCUMENTS

| | | | | |
|---|---|---|---|---|
| 6,828,909 | B2 * | 12/2004 | Script et al. | 340/545.1 |
| 2007/0109121 | A1 * | 5/2007 | Cohen | 340/539.26 |
| 2008/0143525 | A1 * | 6/2008 | Woodbury et al. | 340/547 |
| 2009/0243597 | A1 * | 10/2009 | Spenik et al. | 324/207.22 |

* cited by examiner

*Primary Examiner* — Steven Lim
*Assistant Examiner* — Sisay Yacob
(74) *Attorney, Agent, or Firm* — Steven Stupp; Hudak Consulting Group LLC

(57) ABSTRACT

An electronic device that identifies an environmental condition associated with a portal (such as a door or a window) is described. In particular, a sensor mechanism in the electronic device measures environmental signals associated with the portal, such as vibrations and/or acoustic waves. Then, an integrated circuit in the electronic device analyzes the measured environmental signals to identify the environmental condition. To facilitate the measurements, the electronic device may be mechanically coupled to the portal by an impedance-matching material, so that the vibrations and/or the acoustic waves are coupled to the electronic device. Moreover, the analysis may also be based on measured environmental signals received from one or more additional electronic devices that are mechanically coupled to the portal and/or may involve correcting the measured environmental signals for a mechanical transfer function associated with the portal based on a position of the electronic device on the portal.

20 Claims, 6 Drawing Sheets

PORTAL-SECURITY DETECTION MECHANISM

BACKGROUND

1. Field

The described embodiments relate generally to an electronic device for monitoring a portal. More specifically, the described embodiments relate to techniques for determining an environmental condition associated with a portal.

2. Related Art

Trends in connectivity and in portable electronic devices are resulting in dramatic changes in people's lives. For example, the Internet now allows individuals access to vast amounts of information, as well as the ability to identify and interact with individuals, organizations and companies around the world. This has resulted in a significant increase in online financial transactions (which are sometimes referred to as 'ecommerce'). Similarly, the increasingly powerful computing and communication capabilities of portable electronic device (such as smartphones and tablets), as well as a large and growing set of applications, are accelerating these changes, providing individuals access to information at arbitrary locations and the ability to leverage this information to perform a wide variety of tasks.

Recently, it has been proposed these capabilities be included in other electronic devices that are located throughout our environments, including those that people interact with infrequently. In the so-called 'Internet of things,' it has been proposed that future versions of these so-called 'background' electronic devices be outfitted with more powerful computing capabilities and networking subsystems to facilitate wired or wireless communication. For example, the background electronic devices may include: a cellular network interface (LTE, etc.), a wireless local area network interface (e.g., a wireless network such as described in the Institute of Electrical and Electronics Engineers (IEEE) 802.11 standard or Bluetooth™ from the Bluetooth Special Interest Group of Kirkland, Wash.), and/or another type of wireless interface (such as a near-field-communication interface). These capabilities may allow the background electronic devices to be integrated into information networks, thereby further transforming people's lives.

However, the overwhelming majority of the existing background electronic devices in people's homes, offices and vehicles have neither enhanced computing capabilities (such as processor that can execute a wide variety of applications) nor networking subsystems. Given the economics of many market segments (such as the consumer market segment), these so-called 'legacy' background electronic devices (which are sometimes referred to as 'legacy electronic devices') are unlikely to be rapidly replaced.

These barriers to entry and change are obstacles to widely implementing the Internet of things. For example, in the absence of enhanced computing capabilities and/or networking subsystems it may be difficult to communicate with the legacy electronic devices. Furthermore, even when electronic devices include enhanced computing capabilities and/or networking subsystems, power consumption and battery life may limit the applications and tasks that can be performed.

SUMMARY

The described embodiments relate to an electronic device that includes a mounting mechanism that mechanically couples the electronic device to a portal. Moreover, the electronic device includes a sensor mechanism that measures environmental signals associated with the portal, where the sensor mechanism includes a vibration sensor and/or an acoustic transducer. Furthermore, the electronic device includes an integrated circuit that analyzes the measured environmental signals to identify an environmental condition associated with the portal.

Note that the mounting mechanism may include a surface having an impedance-matching material configured to mechanically couple to the portal.

Moreover, the portal may include a door and/or a window.

In some embodiments, the electronic device includes an interface circuit that communicates the environmental condition to another electronic device. Alternatively or additionally, the interface circuit may communicate with one or more additional electronic devices mechanically coupled to the portal. In these embodiments, the analysis may be based on measured environmental signals provided by the one or more additional electronic devices.

Furthermore, the electronic device may include a power source that provides a power signal to the sensor mechanism and the integrated circuit. Alternatively or additionally, the electronic device may include a receiver circuit that receives a power signal from electromagnetic radiation in an external environment of the electronic device, and that provides the power signal to the sensor mechanism and the integrated circuit.

Note that the analysis may include correcting the measured environmental signals for a mechanical transfer function associated with the portal based on a position of the electronic device on the portal. Moreover, the analysis may be based on historical measurements of the environmental signals.

Furthermore, the sensor mechanism may include: an accelerometer, a velocity sensor, an optical sensor, a position sensor, and/or an orientation sensor.

Additionally, the environmental condition may include: an attempt to force open the portal, forcing open the portal, an attempt to break the portal, breaking the portal, an attempt to pick a lock associated with the portal, picking the lock, an attempt to drill a lock on the portal, an attempt to damage a frame of the portal, an animal entering the portal, a verbal response of a human entering the portal, a knock on the portal, delivery of a package proximate to the portal, inserting an incorrect key into the lock, and/or inserting a correct key into the lock.

Another embodiment provides one of the additional electronic devices described above, which communicates measured environmental signals to the electronic device so that the electronic device can identify the environmental condition associated with the portal.

Another embodiment provides the integrated circuit described above.

Another embodiment provides a system with the electronic device and the one or more additional electronic devices, which were described above.

Another embodiment provides a method for identifying the environmental condition associated with the portal, which may be performed by the electronic device described above. During operation, the electronic device receives measured environmental signals from the one or more additional electronic devices mechanically coupled to the portal, where the environment signals correspond to (or are related to) vibrations and/or acoustic signals, and where the one or more additional electronic devices are at different positions on the portal. Then, the electronic device analyzes the measured environmental signals to identify the environmental condition, where the analysis is based on historical measurements of the environmental signals.

In some embodiments, the analysis involves correcting the measured environmental signals for a mechanical transfer function associated with the portal based on the different positions of the one or more additional electronic devices on the portal.

The preceding summary is provided as an overview of some exemplary embodiments and to provide a basic understanding of aspects of the subject matter described herein. Accordingly, the above-described features are merely examples and should not be construed as narrowing the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
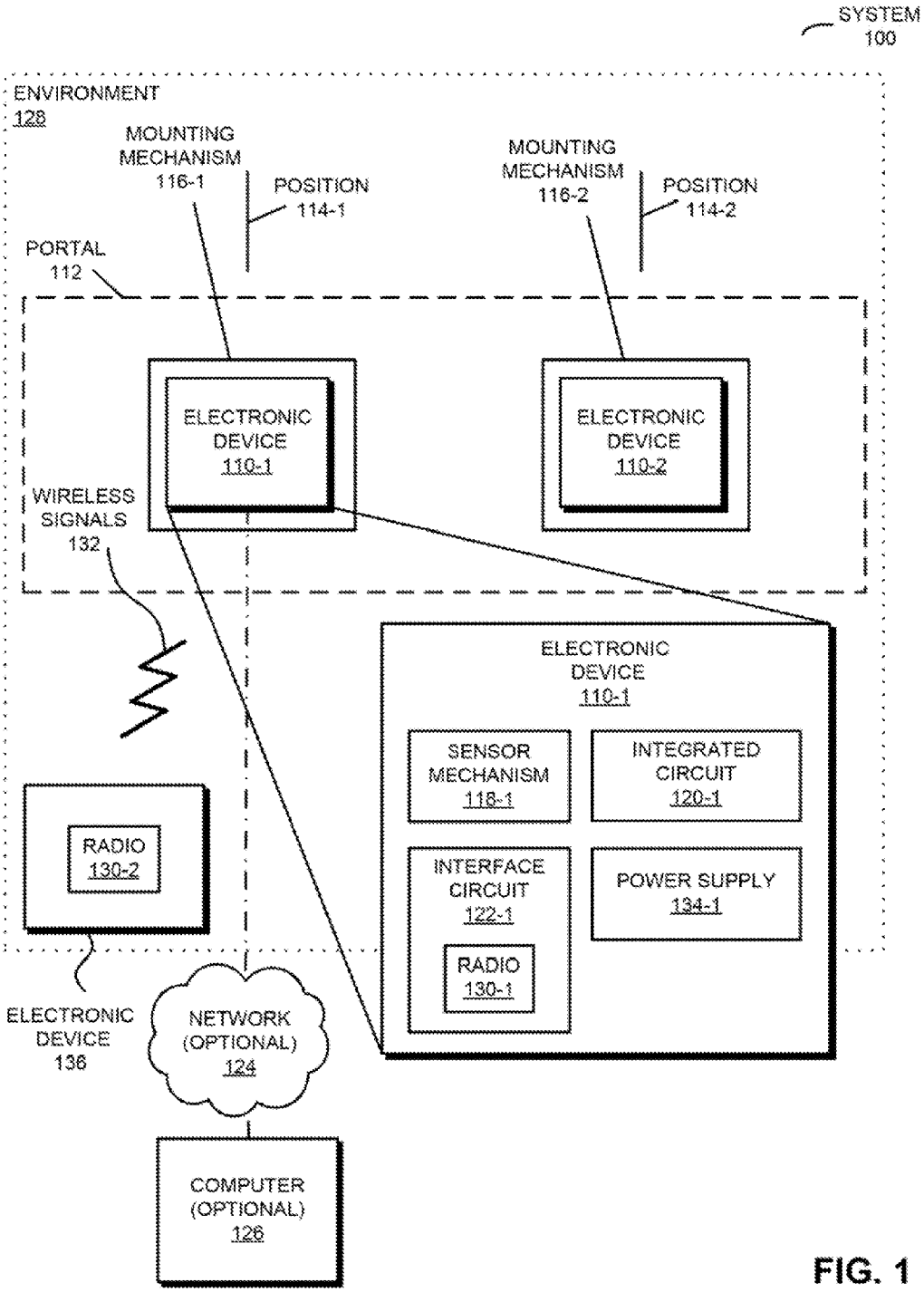
FIG. 1 is a block diagram illustrating a system in accordance with an embodiment of the present disclosure.

An electronic device that identifies an environmental condition associated with a portal (such as a door or a window) is described. In particular, a sensor mechanism in the electronic device measures environmental signals associated with the portal, such as vibrations and/or acoustic waves. For example, the environmental condition may include an attempt to break or force open the portal, or an attempt to pick a lock, which may result in vibrations and/or acoustic waves that are measured by the sensor mechanism. Then, an integrated circuit in the electronic device analyzes the measured environmental signals to identify the environmental condition. To facilitate the measurements, the electronic device may be mechanically coupled to the portal by an impedance-matching material, so that the vibrations and/or the acoustic waves are coupled to the electronic device. Moreover, the analysis may also be based on measured environmental signals received from one or more additional electronic devices that are mechanically coupled to the portal and/or may involve correcting the measured environmental signals for a mechanical transfer function associated with the portal based on a position of the electronic device on the portal.

In this way, the electronic device may monitor the portal to identify the environmental condition. This capability may facilitate a variety of services, such as security or improved awareness of activity associated with the portal. For example, the electronic device may determine when someone knocks on the portal or when a package has been delivered. In addition, the electronic device may represent an environmental monitoring device that: can be deployed or installed rapidly (with low cost and limited effort), may have improved operating life (e.g., increased battery life between recharging or replacement of a battery), and may be easy to use. Thus, the electronic device may provide a compact and low-cost way to monitor the environmental condition associated with the portal in an external environment that includes the electronic device. The resulting improved functionality and services offered by the electronic device may promote sales of the electronic device (and, more generally, commercial activity) and may enhance customer satisfaction with the electronic device.

Note that this environmental-monitoring technique is not an abstract idea. In particular, the monitoring of the environmental condition included in embodiments of the environmental-monitoring technique is not: a fundamental economic principle, a human activity (the operations in the environmental-monitoring technique typically involve measurements in noisy environments), and/or a mathematical relationship/formula. Moreover, the environmental-monitoring technique amounts to significantly more than an alleged abstract idea. In particular, the environmental-monitoring technique may improve the functioning of the electronic device that executes software and/or implements the environmental-monitoring technique. For example, the environmental-monitoring technique may: speed up computations performed during the environmental-monitoring technique (such as the analysis); reduce memory consumption when performing the computations; improve reliability of the computations (as evidenced by improved monitoring of the environmental condition); improve the user-friendliness of a user interface that displays results of the measurements or the analysis (e.g., by allowing a user to view information about the environmental condition associated with the portal); and/or improve other performance metrics related to the function of the electronic device. Furthermore, the measurements performed by the sensor mechanism in the electronic device constitute a technical effect in which information is transformed.

We now describe embodiments of the electronic device. FIG. 1 presents a block diagram illustrating electronic devices 110 in a system 100. This system includes a portal 112 (such as a door or a window) that allows selective access into an enclosure (such as a room or a building) based on a state of the portal (e.g., open or closed). One or more electronic devices 110 may be mechanically coupled to portal 112 at different locations or positions 114 on portal 112. For example, the one or more electronic devices 110 may include at least a portion of or may be coupled to mounting mechanisms 116, such as: a surface that is glued (or attached using an adhesive or tape) onto portal 112; a bracket that is screwed or nailed onto portal 112; a bracket that is attached to portal 112 using a clamp, a cable tie, adhesive tape, a wrap-around material, etc.; a bracket that is welded or soldered to portal 112, etc. Consequently, the mechanical coupling may be remateable or may involve rigid coupling that is not easily reversed.

The one or more electronic devices 110 may monitor portal 112 to facilitate identification of an environmental condition associated with portal 112. Using electronic device 110-1 as an example, sensor mechanism 118-1 may measure environmental signals associated with portal 112. For example, sensor mechanism 118-1 may measure: vibrations, acoustic waves, impulses, a position of portal 112, motion of portal 112, acceleration of portal 112 and, more generally, a parameter associated with displacement of portal 112. Therefore, a wide variety of sensors based on different physical principles may be used in sensor mechanism 118-1 to directly or indirectly detect displacement of portal 112, including: a vibration sensor, an acoustic transducer, an accelerometer, a velocity sensor, an optical sensor, a position sensor, and/or an orientation sensor. In embodiments where sensor mechanism 118-1 measures vibrations and/or acoustic waves (e.g., waves having wavelengths in an acoustic band between 20 Hz and 20,000 Hz or waves associated with mechanical vibrations, such as below a lowest resonance frequency of portal 112), mounting mechanism 116 may include an impedance-matching material (such as a gel, glue, solder, etc.) on a surface facing portal 112 so that the mechanical coupling of the vibrations and/or the acoustic waves to sensor mechanism 118-1 are improved.

One or more of the one or more electronic devices 110 may analyze the measured environmental signals (which are sometimes referred to as 'electrical signals') to identify the environmental condition associated with portal 112. For example, the environmental condition may include: an attempt to force open portal 112, forcing open portal 112, an attempt to break portal 112, breaking portal 112, an attempt to pick a lock associated with portal 112, picking the lock, an attempt to drill a lock on portal 112, an attempt to damage a frame of portal 112, unauthorized usage of portal 112, an animal entering portal 112, a verbal response of a human entering portal 112 (such as 'hi, I'm home'), a knock on portal 112, wind blowing against portal 112, delivery of a package proximate to portal 112, inserting an incorrect key into the lock, inserting a correct key into the lock, and/or a malfunctioning sensor mechanism (such as sensor mechanism 118-1). In particular, electronic device 110-1 may include an integrated circuit 120-1 that analyzes the measurements (e.g., electrical signals) from sensor mechanism 118-1. This analysis may include: filtering (such as with a low-pass filter or a band-pass filter) that removes noise from the electrical signals and, more generally, spectral shaping. In addition, the analysis may include measurements and/or detection using: a voltmeter, an ammeter, a transimpedance amplifier, an amplifier, a phase detector, a resonance monitor, a Fourier analyzer, a spectrum analyzer, a lock-in amplifier (which may be synchronized to a time varying electrical signal having a fundamental frequency that corresponds to waves associated with portal 112), an averaging circuit (that averages multiple measurements of an electrical signal), a heterodyne receiver (and, more generally, a demodulator), and/or another measurement device that measures or captures one or more instances of an electrical signal. Thus, the analysis performed by integrated circuit 120-1 may include synchronous or asynchronous detection.

In some embodiments, the analysis is based on predefined information. In particular, the predefined information (such as a conversion from the parameter to displacement of portal 112) may be obtained locally (on electronic device 110-1) using a stored look-up or conversion table. Alternatively or additionally, an interface circuit 122-1 (or a network interface) in electronic device 110-1 may access the predefined information remotely, such as from optional computer 126 via optional network 124 (such as the Internet, a wireless local area network, an Ethernet network, an intra-net, an optical network, etc.). Thus, the analysis may include converting a measured parameter into displacement of portal 112 using a look-up or conversion table that summarizes values of the parameter and corresponding displacements.

Similarly, the analysis may include correcting the measured environmental signals for a predetermined mechanical transfer function associated with portal 112 (which may be one of the conversion tables) based on a position 114-1 of electronic device 110-1 on portal 112. For example, a Fourier transform (such as a discrete Fourier transform) may convert the measured environmental signals into the frequency domain. Then, the inverse of the mechanical transfer function at position 114-1 may be used to correct for the dynamic response of portal 112 at position 114-1. Next, an inverse Fourier transform may convert the corrected environmental signals into the time domain. Alternatively, the effect of the mechanical transfer function may be removed or corrected for by deconvolving the mechanical transfer function from the measured environmental signals. For example, a door may be modeled as a rectangular drum head with zero (or minimal) displacement at hinges or a lock (when the door is closed). Consequently, there may be modes of vibration with varying displacement at different positions on the door in response to an impulse, such as someone knocking or banging on the door.

Additionally, integrated circuit 120-1 may analyze the measured environmental signals using historical measurements of the environmental signals. For example, integrated circuit 120-1 may obtain the historical measurements locally (on electronic device 110-1) using stored values of the historical measurements. Alternatively or additionally, an interface circuit 122-1 (or a network interface) in electronic device 110-1 may access the historical measurements, such as from optional computer 126 via optional network 124.

Note that the environmental condition may be determined relative to a threshold value (such as a displacement magnitude exceeding 0.01 m or a speed of 0.01 m/s). Thus, the measured environmental signals (or the corrected environmental signals) may be compared to the threshold value, and a binary output may be calculated (e.g., a '0' may be less than the threshold value and a '1' may be greater than the threshold value). Alternatively, the absolute displacement, speed or acceleration may be determined with an accuracy (such as 0.1%). In these ways, the environmental condition (which may include the specified information described above and/or which may be a function of or depend on the specified information) associated with portal 112 (and, more generally, external environment 128 that includes portal 112) may be determined.

Furthermore, when there are multiple instances of electronic devices 110 at different positions 114 along portal 112, the analysis of the measured environmental signals by one or more of electronic devices 110 may use measurements performed by the sensor mechanisms in two or more of electronic devices 110. For example, an interface circuit in electronic device 110-2 may communicate the measurements with interface circuit 122-1. This communication may involve wireless communication of packets. These packets may be included in frames in one or more wireless channels. Consequently, the interface circuits may include radios (such as radio 130-1) that transmit wireless signals 132 (illustrated by jagged lines) to one or more other electronic devices 110, where they are received by an instance of the radio. In general, the wireless communication between electronic devices 110 may or may not involve a connection being established among these electronic devices, and therefore may or may not involve communication via a wireless network. Alternatively or additionally, as described further below with reference to FIG. 5, sensor mechanism 118-1 may include multiple sensors at different positions 114 along portal 112, which communicate measurements to interface circuit 120-1 via wireless signals 132 or wired communication. Furthermore, in some embodiments the communication may occur via portal 112. Notably, a carrier wave (such as a vibration) having a fundamental frequency may convey information using encoding techniques such as: amplitude modulation, frequency modulation, phase modulation, pulse-code modulation, etc.

In some embodiments, electronic device 110-1 includes a power supply 134-1 that provides a power signal to sensor mechanism 118-1 and integrated circuit 120-1. For example, power supply 134-1 may include a battery (and, more generally, a device that includes one or more cells or battery packs, and that converts stored chemical energy into electricity). Alternatively or additionally, power supply 134-1 may include a receiver circuit (or may use interface circuit 122-1) that receives a power signal from electromagnetic radiation in external environment 128 of electronic device 110-1 (such as electromagnetic radiation having at least a fundamental frequency in a band of frequencies), and that provides the power signal to sensor mechanism 118-1 and integrated circuit 120-1. Thus, another electronic device may transmit electromagnetic radiation in external environment 128. This electromagnetic radiation may be received the one or more electronic devices 110 in order to, at least in part, power electronic devices 110.

In some embodiments, power supply 134-1 may include a recharging circuit and a rechargeable battery, where the recharging circuit may recharge the rechargeable battery based on an electrical signal output by power supply 134-1 (e.g., based on the received electromagnetic radiation). Thus, the electromagnetic radiation may be used (directly or indirectly) to power electronic device 110-1, thereby improving operating life or a time between recharges of the rechargeable battery. In some embodiments, the recharging circuit includes: a regulated power supply, a DC power supply, an AC power supply, a switched-mode power supply, etc. This may facilitate the recharging by converting the electrical signal from power supply 134-1 into a DC or an AC electrical signal that is suitable for recharging the rechargeable battery.

After identifying or determining the environmental condition, electronic device 110-1 may use interface circuit 122-1 to communicate this information with one or more other electronic devices, such as electronic device 136 (which may be another instance of electronic device 110, a legacy electronic device, a user's cellular telephone, etc.). For example, electronic device 110-1 may wirelessly communicate packets with information specifying the determined information associated with portal 112 to electronic device 136. These packets may be included in frames in one or more wireless channels. Consequently, electronic device 136 may be receive wireless signals 132 using radio 130-2. In general, the wireless communication between electronic devices 110 and 136 may or may not involve a connection being established among these electronic devices, and therefore may or may not involve communication via a wireless network. Note that the communication between optional computer 126 and electronic devices 110 via optional network 124 may involve a different communication protocol than that associated with wireless signals 132. Thus, the communication via optional network 124 may or may not involve wireless signals 132.

The identified environmental condition may facilitate a variety of services and improved functionality of the electronic devices in FIG. 1. For example, services may be offered to: users associated with electronic devices 110 and/or 136 (such as owners or renters of these electronic devices), suppliers of components or spare parts, maintenance personnel, security personnel, emergency service personnel, insurance companies, insurance brokers, realtors, leasing agents, apartment renters, hotel guests, hotels, restaurants, businesses, organizations, governments, potential buyers of physical objects, a shipping or transportation company, etc. In particular, the identified environmental condition may allow the function or operation of one or more electronic devices in FIG. 1 (such as a legacy electronic device and/or a regulator device, which may or may not directly communicate information with electronic devices 110 and/or 136) to be adapted or changed. For example, an alarm may be sounded if an attempt to force entry via portal 112 is detected. Alternatively, an alert may be provided to a user's cellular telephone when a package is delivered in front of portal 112. In another example, a notification may be sent to a user's cellular telephone when a family pet enters a residence through portal 112 (such as a so-called 'doggy door'), and the user can receive a digest or summary of entries and exits by the pet to determine if the pet is indoors or outdoors. Similarly, when portal 112 is in an open or closed state, another environmental condition in external environment 128 (such as temperature, relative humidity, an allergen concentration, wind stronger than a threshold level blowing against a door, etc.) may be dynamically modified (e.g., by turning a heater on or off, turning a humidifier on or off, turning an air filter on or off, turning a light on or off, etc.). In addition, the service(s) may include maintenance notifications about portal 112 and/or electronic devices 110. For example, based on the identified environmental condition, electronic device 110 may provide a maintenance notification to a user's cellular telephone (e.g., via optional network 124) to perform a remedial action (such as a repair or service to be performed on portal 112, a malfunctioning sensor in electronic device 110-1 and/or correcting unauthorized entry via portal 112 by repairing a lock).

Although we describe the environment shown in FIG. 1 as an example, in alternative embodiments, different numbers or types of electronic devices may be present. For example, some embodiments comprise more or fewer electronic devices. Furthermore, while not shown in FIG. 1, one or more components in electronic device 112 may be coupled or connected by additional signals lines or a bus.

Figure 2:
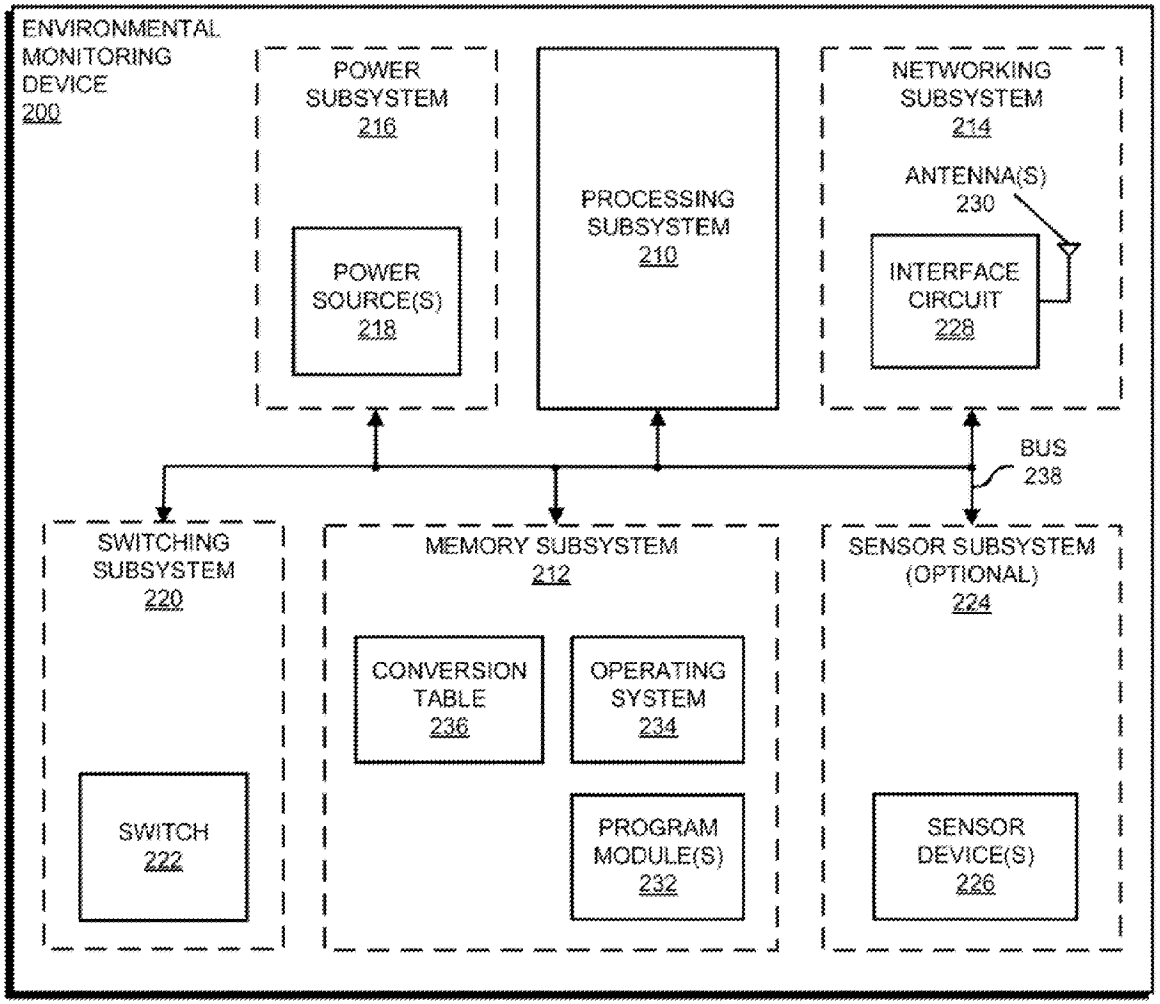
FIG. 2 is a block diagram illustrating an electronic device in the system of FIG. 1 in accordance with an embodiment of the present disclosure.

FIG. 2 presents a block diagram illustrating electronic device 200, which may be one of electronic devices 110 in FIG. 1. This electronic device includes processing subsystem 210 (and, more generally, an integrated circuit or a control mechanism), memory subsystem 212, a networking subsystem 214, power subsystem 216, switching subsystem 220 and optional sensor subsystem 224 (i.e., a data-collection subsystem and, more generally, a sensor mechanism). Processing subsystem 210 includes one or more devices configured to perform computational operations and to execute techniques to process sensor data. For example, processing subsystem 210 can include one or more microprocessors, application-specific integrated circuits (ASICs), microcontrollers, programmable-logic devices, and/or one or more digital signal processors (DSPs).

Memory subsystem 212 includes one or more devices for storing data and/or instructions for processing subsystem 210, networking subsystem 214 and/or optional sensor subsystem 224. For example, memory subsystem 212 can include dynamic random access memory (DRAM), static random access memory (SRAM), and/or other types of memory. Memory subsystem 212 may store one or more conversion tables 236 (such as a table with values of a parameter and the corresponding values of the environmental condition, or a table with values of a mechanical transfer function). In some embodiments, instructions for processing subsystem 210 in memory subsystem 212 include: one or more program modules 232 or sets of instructions, which may be executed in an operating environment (such as operating system 234) by processing subsystem 210. Note that the one or more computer programs may constitute a computer-program mechanism or a program module. Moreover, instructions in the various modules in memory subsystem 212 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 210.

In addition, memory subsystem 212 can include mechanisms for controlling access to the memory. In some embodiments, memory subsystem 212 includes a memory hierarchy that comprises one or more caches coupled to a memory in electronic device 200. In some of these embodiments, one or more of the caches is located in processing subsystem 210.

In some embodiments, memory subsystem 212 is coupled to one or more high-capacity mass-storage devices (not shown). For example, memory subsystem 212 can be coupled to a magnetic or optical drive, a solid-state drive, or another type of mass-storage device. In these embodiments, memory subsystem 212 can be used by electronic device 200 as fast-access storage for often-used data, while the mass-storage device is used to store less frequently used data.

Networking subsystem 214 includes one or more devices configured to couple to and communicate on a wired, optical and/or wireless network (i.e., to perform network operations and, more generally, communication), including an interface circuit 228 (such as a ZigBee® communication circuit) and one or more antennas 230. For example, networking subsystem 214 may include: a ZigBee® networking subsystem, a Bluetooth™ networking system (which can include Bluetooth™ Low Energy, BLE or Bluetooth™ LE), a cellular networking system (e.g., a 3G/4G network such as UMTS, LTE, etc.), a USB networking system, a networking system based on the standards described in IEEE 802.11 (e.g., a Wi-Fi® networking system), an Ethernet networking system, an infra-red communication system, a power-line communication system and/or another communication system (such as a near-field-communication system or an ad-hoc-network networking system).

Moreover, networking subsystem 214 includes processors, controllers, radios/antennas, sockets/plugs, and/or other devices used for coupling to, communicating on, and handling data and events for each supported networking, or communication system. Note that mechanisms used for coupling to, communicating on, and handling data and events on the network for each network system are sometimes collectively referred to as a 'network interface' for the network system. Moreover, in some embodiments a 'network' between the electronic devices does not yet exist. Therefore, electronic device 200 may use the mechanisms in networking subsystem 214 for performing simple wireless communication between electronic device 200 and other electronic devices, e.g., transmitting advertising frames, petitions, beacons and/or information associated with near-field communication.

Moreover, electronic device 200 may include power subsystem 216 with one or more power sources 218. Each of these power sources may include: a battery (such as a rechargeable or a non-rechargeable battery), a DC power supply, a transformer, and/or a switched-mode power supply. Moreover, the one or more power sources 218 may operate in a voltage-limited mode or a current-limited mode. Furthermore, these power sources may be mechanically and electrically coupled by a male or female adaptor to: a wall or electrical-outlet socket or plug (such as a two or three-pronged electrical-outlet plug, which may be collapsible or retractable), a light socket (or light-bulb socket), electrical wiring (such as a multi-wire electrical terminal), a generator, a USB port or connector, a DC-power plug or socket, a cellular-telephone charger cable, a photodiode, a photovoltaic cell, etc. This mechanical and electrical coupling may be rigid or may be remateable. Note that the one or more power sources 218 may be mechanically and electrically coupled to an external power source or another electronic device by one of the electrical-connection nodes in switch 222 in switching subsystem 220.

In some embodiments, power subsystem 216 includes or functions as a pass-through power supply for one or more electrical connectors to an external electronic device (such as an appliance or a regulator device) that can be plugged into the one or more electrical connectors. Power to the one or more electrical connectors (and, thus, the external electronic device) may be controlled locally by processing subsystem 210, switching subsystem 220 (such as by switch 222), and/or remotely via networking subsystem 214.

In addition to sensor mechanism 118-1 (FIG. 1), optional sensor subsystem 224 may include one or more sensor devices 226 (or a sensor array), which may include one or more processors and memory. For example, the one or more sensor devices 226 may include: a thermal sensor (such as a thermometer), a humidity sensor, a barometer, a camera or video recorder (such as a CCD or CMOS imaging sensor), one or more microphones (which may be able to record acoustic information, including acoustic information in an audio band of frequencies, in mono or stereo), a load-monitoring sensor or an electrical-characteristic detector (and, more generally, a sensor that monitors one or more electrical characteristics), an infrared sensor (which may be active or passive), a microscope, a particle detector (such as a detector of dander, pollen, dust, exhaust, etc.), an air-quality sensor, a particle sensor, an optical particle sensor, an ionization particle sensor, a smoke detector (such as an optical smoke detector or an ionizing smoke detector), a fire-detection sensor, a radon detector, a carbon-monoxide detector, a chemical sensor or detector, a volatile-organic-compound sensor, a combustible gas sensor, a chemical-analysis device, a mass spectrometer, a microanalysis device, a nano-plasmonic sensor, a genetic sensor (such as a micro-array), an accelerometer, a position or a location sensor (such as a location sensor based on the Global Positioning System or GPS), a gyroscope, a motion sensor (such as a light-beam sensor), a contact sensor, a strain sensor (such as a strain gauge), a proximity sensor, a microwave/radar sensor (which may be active or passive), an ultrasound sensor, a vibration sensor, a fluid flow sensor, a photo-detector, a Geiger counter, a radio-frequency radiation detector, and/or another device that measures a physical effect or that characterizes an environmental factor or physical phenomenon (either directly or indirectly). Note that the one or more sensor devices 226 may include redundancy (such as multiple instances of a type of sensor device) to address sensor failure or erroneous readings, to provide improved accuracy and/or to provide improved precision.

During operation of electronic device 200, processing subsystem 210 may execute one or more program modules 232, such as an environmental-monitoring application that uses one or more sensor devices 226 to measure environmental signals associated with a portal in an external environment. The resulting measurements may be analyzed by the environmental-monitoring application to identify an environmental condition associated with the portal. Moreover, the identified environmental condition may be used by the environmental-monitoring application to modify operation of electronic device and/or the external electronic device (such as a regulator device), and/or to provide information about the external environment to another (separate) electronic device (e.g., via networking subsystem 214).

Moreover, electrical signals produced by power subsystem 216 (e.g., in response to a received electromagnetic signal) may be used to recharge one or more of power sources 218. For example, this power may, at least in part, offset or compensate for power loss (associated with one or more components in electronic device 200) during operation or a standby mode of electronic device 200 (which is sometimes referred to as a parasitic power loss).

After the environmental condition associated with the portal has been identified, the environmental-monitoring application may share this information with one or more other electronic devices via networking subsystem 214.

Within electronic device 200, processing subsystem 210, memory subsystem 212, networking subsystem 214, power subsystem 216, switching subsystem 220 and/or optional sensor subsystem 224 may be coupled using one or more interconnects, such as bus 238. These interconnects may include an electrical, optical, and/or electro-optical connection that the subsystems can use to communicate commands and data among one another. Note that different embodiments can include a different number or configuration of electrical, optical, and/or electro-optical connections among the subsystems.

Electronic device 200 can be (or can be included in) a wide variety of electronic devices. For example, electronic device 200 can be (or can be included in): a sensor (such as a smart sensor), a tablet computer, a smartphone, a cellular telephone, an appliance, a regulator device, a consumer-electronic device (such as a baby monitor), a portable computing device, test equipment, a digital signal processor, a controller, a personal digital assistant, a laser printer (or other office equipment such as a photocopier), a personal organizer, a toy, a set-top box, a computing device (such as a laptop computer, a desktop computer, a server, and/or a subnotebook/netbook), a light (such as a nightlight), an alarm, a smoke detector, a carbon-monoxide detector, a monitoring device, and/or another electronic device (such as a switch or a router).

Although specific components are used to describe electronic device 200, in alternative embodiments, different components and/or subsystems may be present in electronic device 200. For example, electronic device 200 may include one or more additional processing subsystems, memory subsystems, networking subsystems, power subsystems, switching subsystems, and/or sensor subsystems. Additionally, one or more of the subsystems may not be present in electronic device 200. Moreover, in some embodiments, electronic device 200 may include one or more additional subsystems that are not shown in FIG. 2, such as a user-interface subsystem, a display subsystem, and/or a feedback subsystem (which may include speakers and/or an optical source).

Although separate subsystems are shown in FIG. 2, in some embodiments, some or all of a given subsystem or component can be integrated into one or more of the other subsystems or components in electronic device 200. For example, in some embodiments the one or more program modules 232 are included in operating system 234. In some embodiments, a component in a given subsystem is included in a different subsystem.

Moreover, the circuits and components in electronic device 200 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit may implement some or all of the functionality of networking subsystem 214 (such as a radio) and, more generally, some or all of the functionality of electronic device 200. Moreover, the integrated circuit may include hardware and/or software mechanisms that are used for transmitting wireless signals from electronic device 200 to, and receiving signals at electronic device 200 from other electronic devices. Aside from the mechanisms herein described, radios are generally known in the art and hence are not described in detail. In general, networking subsystem 214 and/or the integrated circuit can include any number of radios. Note that the radios in multiple-radio embodiments function in a similar way to the radios described in single-radio embodiments.

In some embodiments, networking subsystem 214 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals, e.g., determining if the received signal comprises an advertising frame, a petition, a beacon, etc.)

While some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both.

Figure 3:
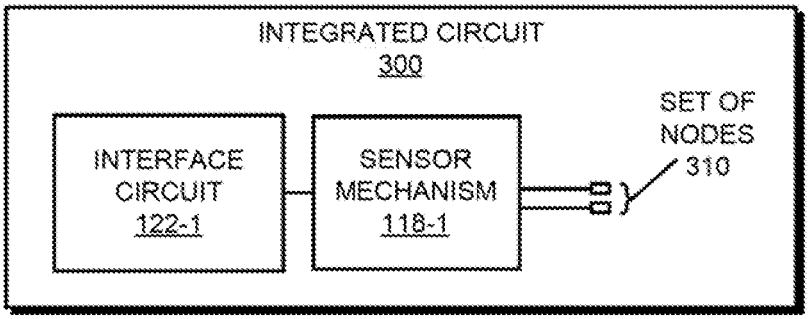
FIG. 3 is a block diagram of an integrated circuit in the electronic device of FIGS. 1 and 2 in accordance with an embodiment of the present disclosure.

Aspects of the environmental-monitoring technique may be implemented using an integrated circuit. This is shown in FIG. 3, which presents a block diagram of integrated circuit 300 in electronic device 200 (FIG. 2). In particular, this integrated circuit may include: sensor mechanism 118-1 (such as one or more sensor devices 226 in FIG. 2); one or more input nodes 310 that electrically couple to other external components; and interface circuit 120-1 (or interface circuit 228 in FIG. 2).

In some embodiments, an output of a process for designing integrated circuit 300, or a portion of integrated circuit 300, which includes one or more of the circuits described herein may be a computer-readable medium such as, for example, a magnetic tape or an optical or magnetic disk. The computer-readable medium may be encoded with data structures or other information describing circuitry that may be physically instantiated as integrated circuit 300 or the portion of integrated circuit 300. Although various formats may be used for such encoding, these data structures are commonly written in: Caltech Intermediate Format (CIF), Calma GDS II Stream Format (GDSII) or Electronic Design Interchange Format (EDIF). Those of skill in the art of integrated circuit design can develop such data structures from schematic diagrams of the type detailed above and the corresponding descriptions and encode the data structures on the computer-readable medium. Those of skill in the art of integrated circuit fabrication can use such encoded data to fabricate integrated circuits that include one or more of the circuits described herein.

Figure 4:
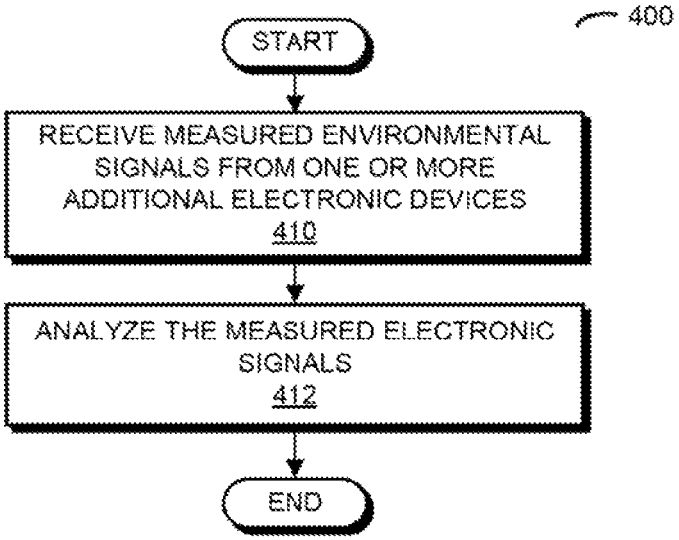
FIG. 4 is a flow diagram illustrating a method for identifying an environmental condition associated with a portal in accordance with an embodiment of the present disclosure.

We now further describe the environmental-monitoring technique and operation of the electronic device. FIG. 4 presents a flow diagram illustrating a method 400 for identifying an environmental condition associated with a portal, which may be performed by one of electronic devices 110 (FIG. 1). During operation, the electronic device receives measured environmental signals from one or more additional electronic devices (operation 410) mechanically coupled to the portal, where the environment signals correspond to (or are related to) vibrations and/or acoustic signals, and where the one or more additional electronic devices are at different positions on the portal. Then, the electronic device analyzes the measured environmental signals (operation 412) to identify the environmental condition, where the analysis is based on historical measurements of the environmental signals (e.g., the measured environmental signals may be compared to the historical measurements to determine a change or deviation from the baseline). Note that the analysis may also be based on measurements of environmental signals associated with the portal performed by the electronic device. Furthermore, in some embodiments the analysis involves correcting the measured environmental signals for a mechanical transfer function associated with the portal based on the different positions of the one or more additional electronic devices on the portal.

Figure 5:
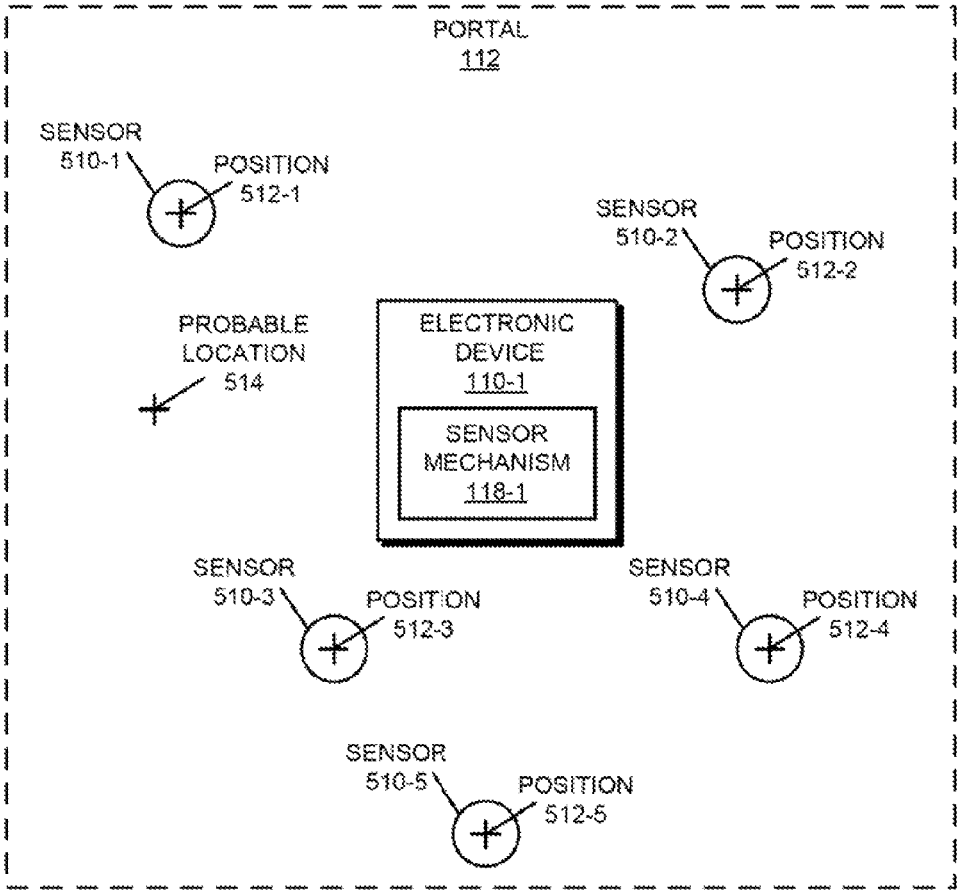
FIG. 5 is a drawing illustrating the method of FIG. 4 in accordance with an embodiment of the present disclosure.

In an exemplary embodiment, sensor mechanism 118-1 measures acoustic signals. This is shown in FIG. 5, which presents a drawing illustrating method 400 (FIG. 4). In this example, instead of different electronic devices, there are multiple sensors 510 associated with sensor mechanism 118-1 at different positions 512 on portal 112. Ideally, sensors 510 may be positioned at antinodes in the response of portal 112 to an impulse. Information about preferred or predetermined positions 512 may be displayed on electronic device 110-1 or may be communicated to a user when they are installing sensors 510 on portal 112. However, in some embodiments a user positions sensors 510 at random positions 512 on portal 112. Note that sensors 510 may communicate measured environmental signals with electronic device 110-1 via wireless communication, wired communication and/or via portal 112 (e.g., using information conveyed in vibrations, such as a modulated waveform having a fundamental frequency that is within or outside of a range of human hearing). In addition, the communication may include unique identifiers of sensors 510 so that electronic device 110-1 can be associated the measured environmental signals with their source (i.e., sensors at particular positions 512).

The measured environmental signals may be analyzed using a lowpass or a bandpass filter that excludes extraneous signals or noise. Furthermore, in addition to or separately from correcting for a mechanical transfer function, the measured environmental signals from sensors 510 may be analyzed as a function of time to determine a probable location 514 of an impulse on portal 112 (such as someone knocking on portal 112). This analysis may be based on a propagation velocity of sound waves on portal 112. Additionally, the analysis may use a Green's function to determine the environmental signals at any given sensor based on the impulse at location 514. As was the case with the previously described correction for the mechanical transfer function, this analysis may be inverted to determine a strength or magnitude of the impulse (such as a peak amplitude of the impulse). This may allow the environmental condition (in this example, someone knocking on portal 112) by comparing the corrected environmental signals to historical measurements or a baseline. In particular, an increase in the environmental signals relative to the baseline may indicate the presence of the environmental condition.

In other examples, sensors 510 may detect a signature for noteworthy activity. For example, sensors 510 may detect the sounds associated with: picking or drilling a lock, kicking in a door, knocking on the door, breaking glass, prying with a crowbar (or other breaking-and-entering noises). Using a knock profile (in a history of knocking sounds) and/or a time of day, delivery of a package may be identified. This may allow electronic device 110-1 to notify a user of electronic device 110-1 that the deliver has arrived. Alternatively, criminals often test doors to see if they are locked. This anomalous activity may be detected, such as if it is at a time of day when no one is present at a residential, commercial or industrial space. If instances of electronic device 110-1 at one location (such as a home) or in a neighborhood (or multiple buildings on a corporate campus) report similar events during a time interval (such as an hour, several hours or consecutive days), one or more of the electronic devices or a central server in communication with the electronic devices may report this to the authorities (such as the police or a security company). In addition, electronic device 110-1 may activate a light near or in proximity to portal 112 to deter a potential criminal. In some embodiments, electronic device 110-1 is used to monitor pets entering via a so-called 'doggie door.'

The combination of time, location, activity on nearby sites, and the activity signature (knocking, attacker door testing, etc.) may allow regular portal activity to be distinguished from anomalous portal activity that can represent real security risks. For example, an activity signature for drilling a door lock may raise alarms. However, if this occurs during normal business hours, and a server in communication with the electronic device queries a database of service orders for a building maintenance schedule and determines that a worker was likely to be drilling and working on a door at that time, the server may notify a staff member or security guard to double check the portal instead of immediately notifying the authorities. Alternatively, if the same activity signature is detected on a bank door at 4 AM, the server may notify the authorities directly and immediately. Note the activity signatures may be recorded in, and compared against, a historical database of activities, which includes: time, location, frequency of occurrence, etc.

The configuration of sensors 510 shown in FIG. 5 is for purposes of illustration. In other embodiments, different configurations or topologies are used. For example, a star topology may be used, with one electronic device and many one-to-one or one-to-hub connections to sensors 510. In another embodiment, serial or chain-type of communication is used between the instances of the electronic device and/or the multiple sensors. In any of these embodiments, the sensors and/or the instances of the electronic device may be arranged in a mesh network in which the communication involves hoping of packets from one electronic device or sensor to an adjacent electronic device or sensor. As noted previously, the communication may be wireless, wired, and/or via vibrations on portal 112 (e.g., an acoustic transducer in the electronic device may transmit or receive information via the vibrations, such as those within or outside of the range of human hearing).

Note that positions 512 of sensors 510 (or a spatial map of sensor positions) may be provided by a user when the user installs sensors 510 on portal 112. However, in other embodiments positions 512 are determined, at least in part, using a local positioning system and/or a Global Positioning System. (Thus, in some embodiments the electronic device includes a position sensor.) More generally, positions 512 of sensors 510 (and/or multiple instances of the electronic device) may be determined using triangulation or trilateration. For example, each one of sensors 510 may transmit a signal in a round-robin fashion, and the time of flight to a remainder of sensors 510 may be measured so that positions 512 can be determined.

Once the environmental condition has been identified, it may be used to guide remedial action. Depending on the environmental condition, this may include providing an alert or an alarm. However, the environmental condition may also be used to modify another environmental condition in the external environment. For example, when a door or window is opened, a switch in the electronic device may selectively electrically couple or decouple another electronic device (such as the regulator device) from a power source. In this way, a regulator device (such as a heater, an air conditioner, an air filter, etc.) may be selectively activated. Alternatively or additionally, the regulation may be related to a medical condition of the user. Note that, while preceding discussion illustrated selective electrical coupling or decoupling based on a static or fixed preference (e.g., the environmental condition), more generally, the regulation may evolve or change as a function of time or with the identified environmental condition, which may allow the electronic device to dynamically respond to or control the other environmental condition.

Figure 6:
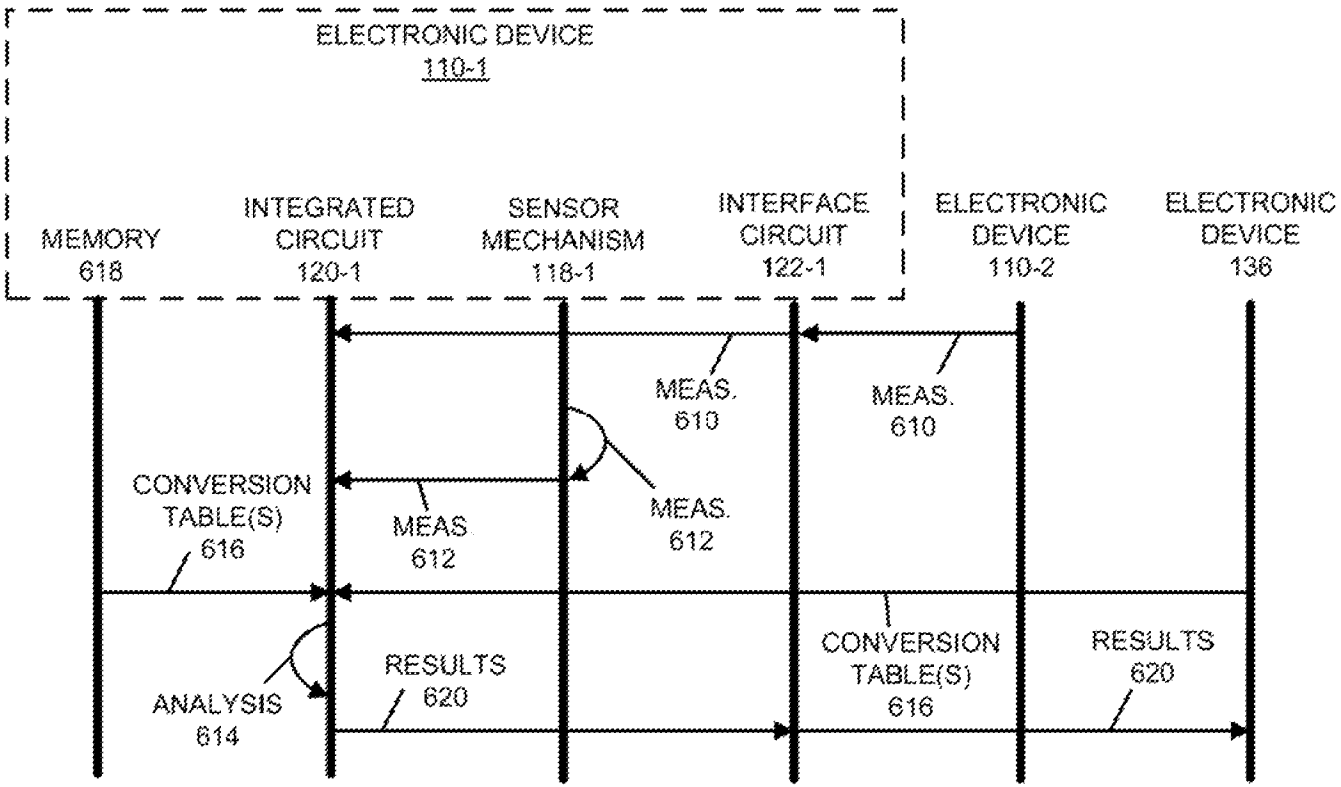
FIG. 6 is a drawing illustrating communication within the electronic device of FIGS. 1 and 2 during the method of FIG. 4 in accordance with an embodiment of the present disclosure.

FIG. 6 presents a drawing illustrating communication within electronic device 110-1 (FIG. 1) during method 400 (FIG. 4). During operation of electronic device 110-1, interface circuit 122-1 optionally receives measurements (meas.) 610 from electronic device 110-2, which are transmitted by electronic device 110-2 when it detects displacement of a portal. These measurements are provided to integrated circuit 120-1. In addition, sensor mechanism 118-1 performs measurements 612 associated with displacement of the portal, and these measurements are provided to integrated circuit 120-1.

In response, integrated circuit 120-1 analyzes 614 measurements 610 and/or 612. This analysis may optionally involve the use of one or more conversion tables 616, which may be received from memory 618 or from another external device (such as electronic device 136) via interface circuit 122-1.

Subsequently, integrated circuit 120-1 provides results 620 of analysis 614 (such as the identified environmental condition) to interface circuit 122-1, and interface circuit 122-1 communicates results 620 to another electronic device, such as electronic device 136.

While the preceding example illustrated integrated circuit 120-1 performing operations in the environmental-monitoring technique, in other embodiments at least some of these operations are performed by a processor in electronic device 110-1 (i.e., at least some of the operations may be performed by software executed by the processor).

In some embodiments of one or more of the preceding methods, there may be additional or fewer operations. Furthermore, the order of the operations may be changed, and/or two or more operations may be combined into a single operation. In addition, in some of the preceding embodiments there are fewer components, more components, a position of a component is changed and/or two or more components are combined.

While the previous discussion illustrated the electronic device mounted on the portal, in other embodiments (such as those in which there are multiple instances of the sensor associated with the electronic device) the electronic device may be mounted near the portal. For example, the electronic device may be mounted on: a wall, a cabinet, the ground/floor, an enclosure, and/or near the portal.

In the preceding description, we refer to 'some embodiments.' Note that 'some embodiments' describes a subset of all of the possible embodiments, but does not always specify the same subset of embodiments.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. An electronic device, comprising:

a mounting mechanism configured to mechanically couple to a portal;

a sensor mechanism configured to measure environmental signals associated with the portal, wherein the sensor mechanism includes one of: a vibration sensor and an acoustic transducer; and an integrated circuit, electrically coupled to the sensor mechanism, configured to analyze the measured environmental signals to identify an environmental condition associated with the portal, wherein the analysis includes correcting the measured environmental signals for a mechanical transfer function associated with the portal based on a position of the electronic device on the portal.

2. The electronic device of claim 1, wherein the mounting mechanism includes a surface having an impedance-matching material configured to mechanically couple to the portal so that one of acoustic waves and vibrations couple to the electronic device.

3. The electronic device of claim 1, wherein the portal includes one of: a door, and a window.

4. The electronic device of claim 1, further comprising an interface circuit configured to communicate the environmental condition to another electronic device.

5. The electronic device of claim 1, further comprising an interface circuit configured to communicate with one or more additional electronic devices mechanically coupled to the portal at different positions on the portal; and wherein the analysis is based on measured environmental signals provided by the one or more additional electronic devices.

6. The electronic device of claim 1, further comprising a power source, electrically coupled to the sensor mechanism and the integrated circuit, configured to provide a power signal to the sensor mechanism and the integrated circuit.

7. The electronic device of claim 1, further comprising a receiver circuit, electrically coupled to the sensor mechanism and the integrated circuit, configured to receive a power signal from electromagnetic radiation in an external environment of the electronic device, and to provide the power signal to the sensor mechanism and the integrated circuit.

8. The electronic device of claim 1, wherein correcting the measured environmental signals includes correcting for modes of vibration of the portal with varying displacement at different positions on the portal in response to an impulse.

9. The electronic device of claim 1, wherein the analysis is based on historical measurements of the environmental signals that are used to determine a baseline; and wherein identifying the environmental condition involves detecting a change relative to the baseline.

10. The electronic device of claim 1, wherein the sensor mechanism further includes one of: an accelerometer, a velocity sensor, an optical sensor, a position sensor, and an orientation sensor.

11. The electronic device of claim 1, wherein the environmental condition includes one of: an attempt to force open the portal, forcing open the portal, an attempt to break the portal, breaking the portal, an attempt to pick a lock associated with the portal, picking the lock, an attempt to drill a lock on the portal, an attempt to damage a frame of the portal, an animal entering the portal, a verbal response of a human entering the portal, a knock on the portal, delivery of a package proximate to the portal, inserting an incorrect key into the lock, and inserting a correct key into the lock.

12. An electronic device, comprising:

a mounting mechanism configured to mechanically couple to a portal;

a sensor mechanism configured to measure environmental signals associated with the portal, wherein the sensor mechanism includes one or more of: a vibration sensor and an acoustic transducer;

an integrated circuit, electrically coupled to the sensor mechanism, configured to analyze the measured environmental signals to correct the measured environmental signals for a mechanical transfer function associated with the portal based on a position of the electronic device on the portal; and an interface circuit, electrically coupled to the integrated circuit, configured to communicate the corrected environmental signals to another electronic device to identify an environmental condition associated with the portal.

13. The electronic device of claim 12, wherein the mounting mechanism includes a surface having an impedance-matching material configured to mechanically couple to the portal so that one of acoustic waves and vibrations couple to the electronic device.

14. The electronic device of claim 12, wherein the portal includes one of: a door, and a window.

15. The electronic device of claim 12, further comprising a power source, electrically coupled to the sensor mechanism and the interface circuit, configured to provide a power signal to the sensor mechanism and the interface circuit.

16. The electronic device of claim 12, further comprising a receiver circuit, electrically coupled to the sensor mechanism and the interface circuit, configured to receive a power signal from electromagnetic radiation in an external environment of the electronic device, and to provide the power signal to the sensor mechanism and the interface circuit.

17. The electronic device of claim 12, wherein the sensor mechanism further includes one or more of: an accelerometer, a velocity sensor, an optical sensor, a position sensor, and an orientation sensor.

18. The electronic device of claim 12, wherein the environmental condition includes one of: an attempt to force open the portal, forcing open the portal, an attempt to break the portal, breaking the portal, an attempt to pick a lock associated with the portal, picking the lock, an attempt to drill a lock on the portal, an attempt to damage a frame of the portal, an animal entering the portal, a verbal response of a human entering the portal, a knock on the portal, delivery of a package proximate to the portal, inserting an incorrect key into the lock, and inserting a correct key into the lock.

19. An electronic-device-implemented method for identifying an environmental condition associated with a portal, wherein the method comprises:

receiving measured environmental signals from one or more additional electronic devices mechanically coupled to the portal, wherein the environment signals correspond to one of: vibrations and acoustic signals, and wherein the one or more additional electronic devices are at different positions on the portal; and using the electronic device, analyzing the measured environmental signals to identify the environmental condition, wherein the analysis is based on historical measurements of the environmental signals, and wherein the analysis involves correcting the measured environmental signals for a mechanical transfer function associated with the portal based on the different positions of the one or more additional electronic devices on the portal.

20. The method of claim 19, wherein correcting the measured environmental signals includes correcting for modes of vibration of the portal with varying displacement at different positions on the portal in response to an impulse.

* * * * *